US009341188B2

(12) United States Patent
Kogame

(10) Patent No.: US 9,341,188 B2
(45) Date of Patent: May 17, 2016

(54) BOLT-FASTENING SYSTEM FOR TURBOMOLECULAR PUMP, AND A PUMP CONTAINING THE SAME

(75) Inventor: Masahito Kogame, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 473 days.

(21) Appl. No.: 13/995,872

(22) PCT Filed: Feb. 7, 2012

(86) PCT No.: PCT/JP2012/052688

§ 371 (c)(1),
(2), (4) Date: Aug. 20, 2013

(87) PCT Pub. No.: WO2012/114862

PCT Pub. Date: Aug. 30, 2012

(65) Prior Publication Data

US 2013/0336762 A1 Dec. 19, 2013

(30) Foreign Application Priority Data

Feb. 22, 2011 (JP) ..... 2011-036013

(51) Int. Cl.

| | |
|---|---|
| ***F01B 25/16*** | (2006.01) |
| ***F04D 19/04*** | (2006.01) |
| ***F04D 27/00*** | (2006.01) |
| ***F04D 29/64*** | (2006.01) |
| ***F04D 29/60*** | (2006.01) |

(52) U.S. Cl.

CPC ..... *F04D 19/04* (2013.01); *F04D 19/042* (2013.01); *F04D 27/008* (2013.01); *F04D 29/601* (2013.01); *F04D 29/644* (2013.01)

(58) Field of Classification Search

CPC ..... F04D 19/04; F04D 19/042; F04D 29/601; F04D 29/644; F04D 27/008; Y10T 403/64; Y10T 403/645; Y10T 403/75; E04H 12/085; F01D 25/243; F16D 1/033; F16D 1/076; F16L 23/00; F16L 27/1012; F16L 47/14; F16L 49/04

USPC ..... 415/9, 90

See application file for complete search history.

(56) References Cited

FOREIGN PATENT DOCUMENTS

| | | |
|---|---|---|
| JP | 2007-278163 | 10/2007 |
| JP | 2008-75489 | 4/2008 |
| JP | 2010-180732 | 8/2010 |
| JP | 4609082 | 1/2011 |
| WO | WO 2008/035497 | 3/2008 |

OTHER PUBLICATIONS

PCT/JP2012/052688, International Search Report mailed May 15, 2012, 2 pages—Japanese, 2 pages—English.

JP 2012 80003754.1, Office Action issued Feb. 3, 2014, 10 pages—English; 6 pages—Japanese.

*Primary Examiner* — Thomas Denion

*Assistant Examiner* — Kelsey Stanek

(74) *Attorney, Agent, or Firm* — Andrew F. Young, Esq.; Lackenbach Siegel, LLP

(57) ABSTRACT

A bolt fastening system for a turbomolecular pump wherein a first member is fastened in an axial direction with respect to a second member by multiple bolts arranged concentrically with respect to a rotor shaft center. The bolt-fastening system equipped with multiple pairs of non-penetrating pinholes arranged concentrically with respect to a rotor shaft center and formed opposing one another in respective opposing faces of the fastened first and second members, and equipped with pins provided for each pair of pinholes and inserted into the pairs of pinholes. When the size of a gap between a bolt and a bolt hole formed in the first member is Db, and a sizes of the gaps between the pins and the pinholes formed in the first and second members are Dp1 and Dp2, the gap sizes Db, Dp1, and Dp2 satisfy the equation Db≥(Dp1+Dp2).

13 Claims, 6 Drawing Sheets

(a)

Cross Section View at Line B-B (b)

Cross Section View At Line C-C

Cross Section View at Line B-B

BOLT-FASTENING SYSTEM FOR TURBOMOLECULAR PUMP, AND A PUMP CONTAINING THE SAME

CROSS REFERENCE TO RELATED APPLICATIONS

This application relates to and claims priority from Ser. No. PCT/JP2012/052688 filed Feb. 7, 2012, which in turn relates to and claims priority from JP Ser. No. 2011-036013 filed Feb. 2. 2011, the entire contents of each of which are incorporated herein by reference.

TECHNICAL FIELD

The present invention relates to a bolt-fastening structure of a turbomolecular pump and a turbomolecular pump comprising the bolt-fastening structure for the turbomolecular pump.

BACKGROUND

A structure fixed by plural number of bolts that are concentrically arranged is common to hasten respective members which structure a turbomolecular pump. A rotor of turbomolecular pump is rotating at a high speed with several tens of thousands r. p. m. and given the rotor is broken in case while rotating, a strong force (a high impact) in a rotating direction can be transferred to a static site, e.g. a pump casing, due to the rotation energy thereof. Accordingly, a technology to interrupt transferring such strong impact to the side of a vacuum chamber through the pump casing by plastic-deforming a bolt that is fixing the pump to an equipment and a bolt that is fastening a pump casing and a base thereof is known as a technology to absorb the impact. (Referring, for example, to Patent Document 1)

PRIOR ARTS

Patent Document

Patent Document 1 Patent Publisher JP 2010-180732.

SUMMARY OF INVENTION

Problems to be Solved by the Invention

However, in the above structure by which the energy on breaking is absorbed by deforming bolts, the plastic-deformation region of metal strength is too close to the state of fracture; and accordingly, if an error with respect to an estimate of anticipated breaking energy is large, or if a breaking energy occurs more than anticipated, the bolts might be likely broken as results.

Means for Solving the Problem

According to Embodiment 1 of the present invention, a bolt-fastening structure of a turbomolecular pump, wherein a first member is fastened in the shaft direction with respect to a second member by means of plural bolts arranged concentrically with respect to the rotor shaft center; comprises a pair of non-penetrating pinholes of which plurality are arranged concentrically with respect to the rotor shaft center and forming as opposing each other in the respective opposing faces of the fastened first and second members, and a pin that is provided for every pair of pinholes and inserted into the certain pair of pinholes, wherein if a gap-size between the bolt and the bolt hole formed in the first member is Db, and each gap-size between the pin and the pair of pinholes formed in the first member and second member is Dp1, Dp2, the gap-size Db, Dp1, Dp2 can be set to satisfy an equation, Db1≥(Dp1+Dp2).

According to Embodiment 2 of the present invention, a bolt-fastening structure of a turbomolecular pump, wherein a first member is fastened in the shaft direction with respect to a second member by means of plural bolts and nuts arranged concentrically with respect to the rotor shaft center; comprises a pair of non-penetrating pinholes of which plurality are arranged concentrically with respect to the rotor shaft center and forming as opposing each other in the respective opposing faces of fastened the first and second members, and a pin that is provided for every pair of pinholes and inserted into the certain pair of pinholes, wherein if a gap-size between the bolt and the bolt hole formed in said first member is Db1 and a gap-size between the bolt and the bolt hole formed in the first member is Db2, each gap-size between said pin and said pair of pinholes formed in the first member and second member is Dp1, Dp2, the gap-size Db1, Db2, Dp1 Dp2 can be set to satisfy an equation, (Db+Db2)≥(Dp1+Dp2).

According to Embodiment 3 of the present invention, a bolt-fastening structure of a turbomolecular pump according to Embodiment 1 or Embodiment 2 is formed at least in one side of the pair of pinholes, wherein a pin mounting confirmation hole that is penetrating through the bottom of pinhole and has a smaller diameter than the pinhole.

According to Embodiment 4 of the present invention, a turbomolecular pump according to one of Embodiment 1 through Embodiment 3 comprises a bolt-fastening structure, wherein a parallel pin is used as the pin.

According to Embodiment 5 of the present invention, a turbomolecular pump according to one of Embodiment 1 through Embodiment 4 comprises a rotor; a pump-casing that is storing the rotor, in which a flange is formed as the first member; and a pump-base as the second member, on which the pump-casing is fixed; wherein if a number of the pins is N, a rotation torque of the pump-base that occurs when the rotor is broken is $\tau b$, and a load required on breaking in the shear direction (withstanding torque value) per one pin is $\tau p$; a number of the pins N can be set to satisfy an equation $N \geq \tau b/\tau p$.

EFFECT OF THE INVENTION

According to the present invention, a safety of a turbomolecular pump can be improved.

BRIEF DESCRIPTION OF THE DRAWINGS

FIG. 3(*b*) is illustrating a cross section along the line C-C in FIG. 2.

EMBODIMENTS

Figure 1:
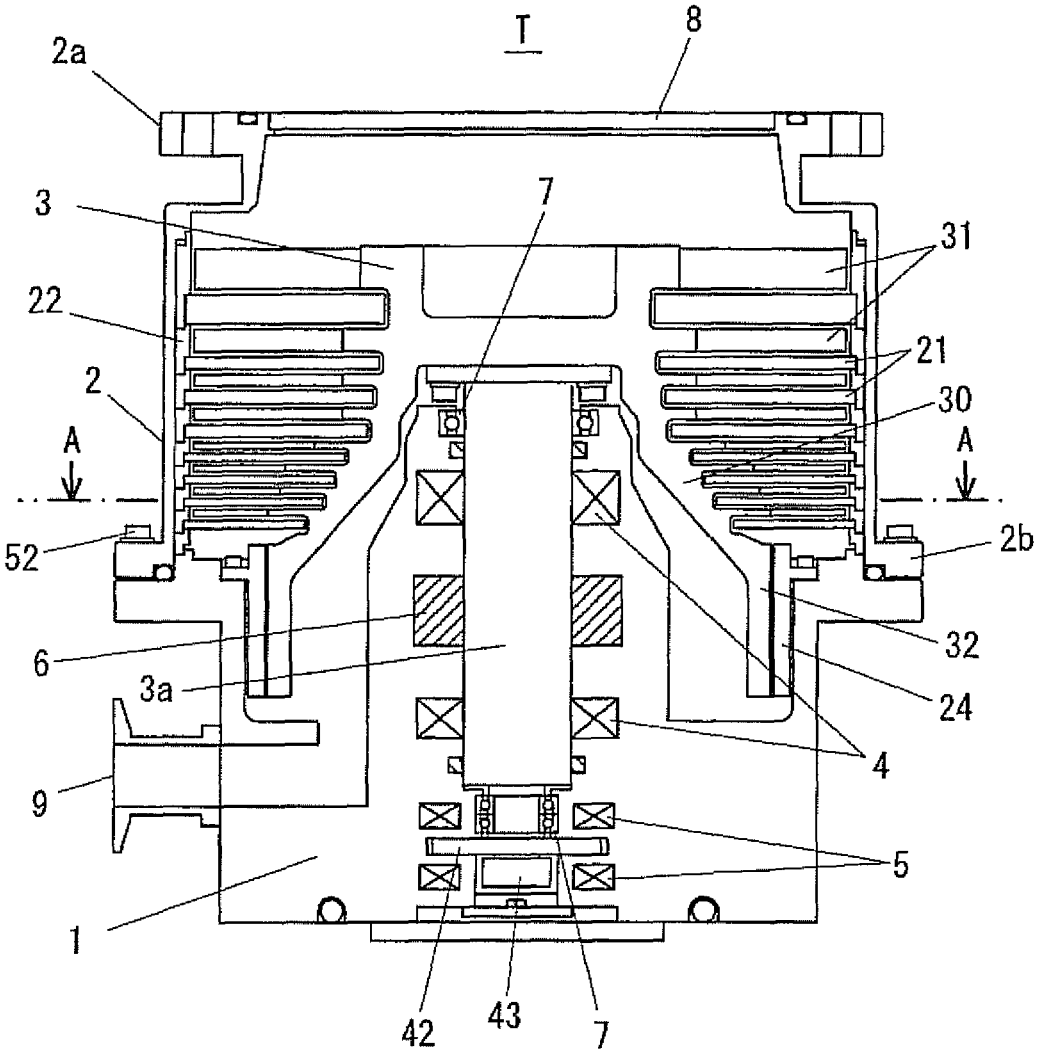
FIG. 1 is a cross sectional view illustrating a schematic constitution of a pump body of magnetic bearing turbomolecular pump.

Embodiment of the present invention is now illustrated referring to figures. FIG. 1 is a cross sectional view illustrating a schematic constitution of the pump body of magnetic bearing turbomolecular pump. Such a turbomolecular pump is used to conduct vacuum exhaustion inside a chamber mounted such as in a semiconductor production apparatus.

The pump main body T of turbomolecular pump comprises a base 1, an approximate cylinder type casing 2 is mounted on the top surface of base 1 and a rotor 3 rotatably is mounted in the casing 2. A flange 2*b* is mounted in the lower end of the casing 2, wherein the flange 2*b* and the base 1 is fastened with plural bolts 52. An air inlet flange element 2*a* mounted in the upper end of the casing 2 are fastened to a flange of a vacuum chamber in the semiconductor production apparatus side, not shown in Fig., with bolts.

The rotor 3 to be rotated at a high speed is made of aluminum alloy having a high specific strength so that it can withstand centrifugal force. The rotor 3 is fastened to the rotation shaft element 3*a* which is rotatable and supported inside the base 1. The rotation shaft element 3*a* is supported with a non-contact pair of both radial magnetic bearings 4 and axial magnetic bearings 5, and is driven to rotate by a motor 6. Axial magnetic bearings 5 are mounted to sandwich a rotor disk 42, which is mounted in lower part of rotation shaft element 3*a,* from above and beneath. The rotor disk 42 is mounted to the rotation shaft element 3*a* with a fixing nut 43.

Plural laminar rotation vanes 31, having a space in-between in the shaft direction, are formed on the external surface of bell shape tube element 30 of the rotor 3. Further, an approximate cylinder shape rotation cylinder element 32 is extended underneath the bell shape cylinder tube element 30. Specifically, the rotation vanes 31 in the high vacuum side and the rotation cylinder element 32 in the low vacuum side are mounted. According to Embodiment 1 shown in FIG. 1, an external diameter of the rotation cylinder element 32 is set as larger than an external diameter of the bell shape tube element 30. A rotation side exhaustion function element comprises plural laminations of rotation vane 31 formed in the rotor 3 and the rotation cylinder element 32.

A DC brushless motor, for example, can be used as a motor 6. In that case, a motor rotor having a built-in permanent magnet is mounted in the rotation shaft element 3*a* side and a motor stator to form a rotation magnetic field is mounted in the base 1 side. Further, an emergency mechanical bearing 7 to work when a magnet bearing 4, 5 is in trouble is mounted in the base 1 side.

A fixed vane 21 is alternatively inserted and mounted between respective laminations of the rotor vane 31 formed in the rotor 3. A turbine vane element comprises these rotation vanes 31 and fixed vanes 21. The fixed vane 21 of each lamination is laminated through a spacer 22, and a laminated body can be formed by these fixed vanes 21 and spacers 22. The spacer 22 forms approximate ring shape and the fixed vane 21 forms a halved shape dual-partitioned in a circumferential direction. A laminar body comprising a fixed vane 21 and a spacer 22 is sandwiched between the upper end of the base 1 and the upper end of the casing 2 with a fastening force of bolts 52. The circumference of the laminar body is covered by the casing 2.

A fixed cylinder 24 facing the external surface of rotation cylinder element 32 is mounted in the circumference of rotation cylinder element 32. The fixed cylinder 24 is fixed to the base 1 with a bolt. A spiral groove is formed on the internal surface of the fixed cylinder 24 and the gap between the rotation cylinder 32 and the fixed cylinder 24 forms a gas passage in both upward and downward directions. In such a turbomolecular pump in which a molecular drag pump comprises these rotation cylinder element 32 and fixed cylinder 24, when the rotor 3 is rotated by the motor 6 at a high speed, the inlet gas molecules through air inlet 8 in the upper end of the casing are exhausted from exhaust outlet 9 through each gas passage of turbine vanes and the molecular drag pump element. According to this gas molecular flow, the air inlet 8 side becomes in a high vacuum state.

In the turbomolecular pump, as the rotor 3 rotates at a high speed, the rotor 3 during rotation becomes highly centrifugally-stressed. In particular, the rotation cylinder element 32 is highly-stressed and in many cases, a breaking-down occurs from the rotation cylinder element 32 thereof. If the rotation cylinder element 32 is broken, a scattering of piece due to breaking-down collides to the fixed cylinder 24 by centrifugal force, and then a large rotation torque in the same direction as the rotation direction of the rotor 3 occurs in the base 1 in which the fixed cylinder 21 is fixed. Accordingly, in the conventional manner, a number of bolts 52 fastening a base 1 and a casing 2 is commonly set as larger than a number of bolts, which is obtained from the formula, (estimating rotation torque/withstanding torque value per bolt), so that the system can tolerate against the rotation torque when it breaks.

However, in a case of a bolt, a cross section area at the bottom of bolt-screw is a smaller cross section area than other areas and the cross section shape of the bottom of screw is sharp angular, and therefore the concentration stress occurs easily at the bottom of screw. Accordingly, in a fastening structure in which bolts 52 alone support rotation torques, there is a drawback of which a breaking-down of bolt occurs likely at the bottom of screw where a concentration stress occurs.

Figure 2:
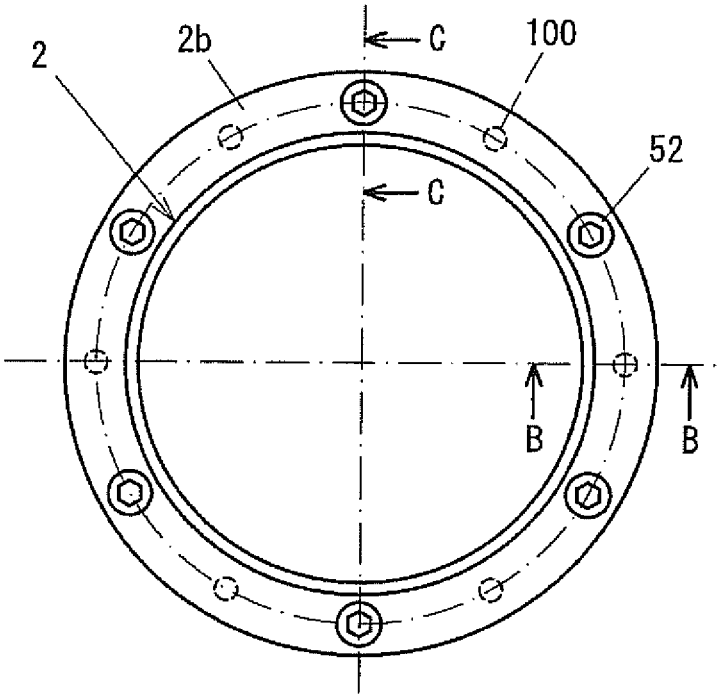
FIG. 2 is a cross sectional view along the line A-A of the casing 2 and the base 1 shown in FIG. 1 illustrating a fastening structure of the casing 2 and the base 1.
Figure 3:
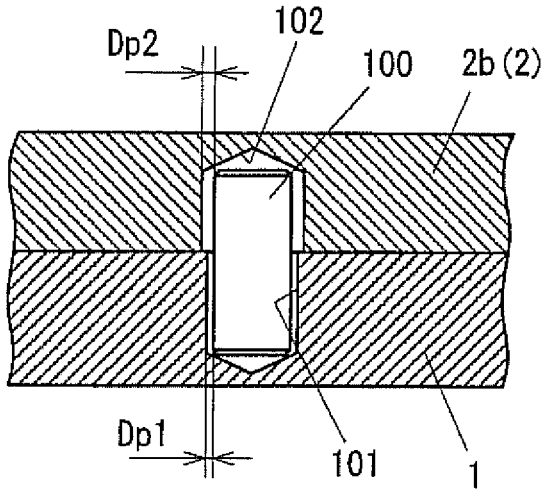
FIG. 3(*a*) is illustrating a cross section along the line B-B in FIG. 2.
Figure 3:
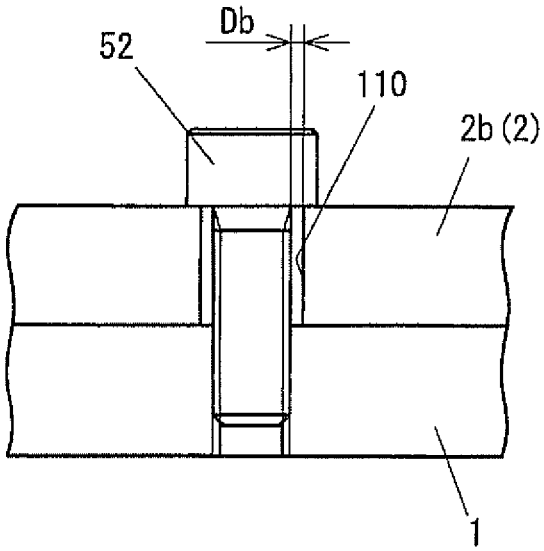

According to Embodiment of the present invention following concerns and the like, a fastening structure of base 1 and casing 2 are the structure as shown in FIG. 2 and FIG. 3. FIG. 2 and FIG. 3 are figures illustrating a fastening structure of casing 2 and base 1 shown in FIG. 1. FIG. 2 is a cross-sectional view along the line A-A of the casing 2 and the base 1 shown in FIG. 1. Referring to FIG. 1, a flange 2*b* is formed at the bottom of the casing 2, and the casing 2 is fixed to the base 1 by fastening the flange 2*b* to the base 1 with bolts. According to Embodiment referring to FIG. 2, 6 bolts 52 are used.

The casing 2 is fixed to the base 1 so that the center shaft thereof is approximately coincide with the center shaft of the rotor 3, and a bolt hole 1 la formed in the flange 2*b* is mounted concentrically with respect to the center shaft of casing 2. Further, a member shown as reference 100 in FIG. 2 is a pin that is mounted in the fastening element of the base 1 and the casing 2. A parallel pin, for example, can be used as a pin 100, and wherein 6 pins 100 are mounted in the same circle as the concentric circle in which bolts 52 are mounted.

FIG. 3(*a*) is a cross section along the line B-B in FIG. 2 and FIG. 3(*b*) is a cross section along the line C-C in FIG. 2. Referring to FIG. 3(*a*), a non-penetrating pinhole 101, 102 is mounted in a base 1 and a flange 2*b*. The pin 100 is stored in a bag shape pinhole formed by the pinhole 101, 102. A length of pin 100 and depth of each pinhole 101, 102 is mounted so that the pin 100 can be absolutely inserted into both pinholes 101, 102 whenever the pump body T is in either an erect position or an inversed position.

According to Embodiment of the present invention, when a casing 2 is fixed to a base 1 with bolts, a pin 100 is structurally inserted into a pinhole 101 in the base 1 side in advance. Therefore, a gap-size Dp1 between the pin 100 and the pinhole 101 is set as smaller than a gap-size Dp2 between the pin 100 and the pinhole 102.

On the other hand, referring to FIG. 3(*b*), a bolt 52 is screwed together with a female screw formed in the base side with respect to the fastening structure. An internal dimension of a bolt-hole 11*a* is set so that a gap-size Db between the bolt-shaft and the bolt-hole 11*a* can be formed. Further, the gap-size Dp1, Dp2 between the pinhole 101, 102 and the pin 100 and the gap-size Dp are set so that they satisfy an equation (1).

$$Db \geq (Dp1 + Dp2) \quad (1)$$

The equation (1) is a condition under which the pin 100 contacts the internal surface of the pinhole 101, 102 before the bolt shaft of 52 contacts the internal surface of the bolt 110 when a rotation torque to the base 1 occurs along with breaking-down of the rotor. Specifically, only the pin 100 bears structurally the rotation torque. In this case, the number of pins 100 N satisfies Equation (2), wherein τb is a rotation torque of the base 1 occurs when the rotor is broken, and a required load per pin (withstanding torque value) τp to break in a shear direction.

$$N \geq \tau b / \tau p \quad (2)$$

As described above, the pin 100 is mounted in the bolt fastening element so that the rotation torque when the rotor is broken can be forced on the pin 100 earlier than on the bolt 52. Further, the pin is set to satisfy Equation (2) so that the pin 100 can be prevented from breaking-down. Further, the pin 100 is made of a member like a parallel pin of which a cross section has a uniform and smooth surface in the shaft direction so that occurrence of stress-concentration at the bottom of groove can be prevented.

When a pin 100 and a pinhole 101, 102 are deformed by an impact, it is absolutely sure that a bolt 52 also bears a rotation torque but a magnitude thereof is substantially small. Therefore, tension strength as strength of bolt 52 in the shaft direction on fastening should be mainly considered and the number of bolts 52 can be reduced compared to a conventional fastening structure in which bolts 52 bears a rotation torque.

Accordingly, from functional standpoints, a pin 100 bears a rotation torque and a bolt 52 fixes a casing 2 to a base 1, respectively, so that a cost thereof can be cut due to reduction of number of bolts and further a labor for fastening can be simplified along with reduction of number of bolts.

Figure 4:
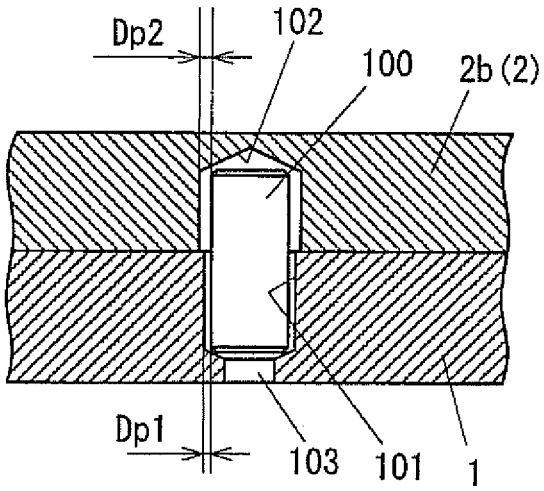
FIG. 4 is a figure illustrating a deformed example of pinhole 101. 102.

FIG. 4 is a figure illustrating a deformed example of pinhole 101, 102 in which a pin 100 is mounted. According to this Embodiment with respect to deformation, a penetrating pinhole 103 having a smaller diameter than a pinhole 2 at the bottom of the pinhole 102 was formed. The penetrating hole 103 has following functions.

The first function of the penetrating hole 103 is as a confirmation window to confirm whether a pin 100 is mounted in a pinhole 101, 102. Referring to FIG. 3(*a*), with respect to a pinhole 101, 102, it cannot be confirmed whether a pin 100 is mounted in the pinhole 101, 102 after bolts are hastened. In contrast, referring to FIG. 4, with respect to a pinhole 101, 102, it can be absolutely confirmed whether there is a pin 100 or not through a penetrating hole 103 even after bolts are hastened so that it can be prevented from forgetting the mounting with respect to the pin 100.

The second function of the penetrating hole 103 is as a working hole to remove a pin 100 when the pin 100 would break into the side wall of the pinhole 101 and then becomes unable to be pulled out due to a force of rotation torque to the pin 100. In that case, a rod-like jig can be inserted through the penetrating hole 103 to easily remove the pin 100 from the pinhole 101 by hammering the pin 100. According to Embodiment of the present invention, since the diameter of pinhole 101 is smaller than the diameter of pinhole 102, the pin 100 easily remains in the pinhole 101. However, considering when the pin 100 remains in the pinhole 102, a penetrating hole 103 can be formed in both pinhole 101, 102.

Further, according to the above Embodiment of the present invention, not only the illustrated bolt fastening structure with a base 1 and a casing 2, but also it can be applied to a bolt fastening structure with other elements. For example, it can be applied to the bolt fastening element of rotor 3 and rotation shaft element 3*a* but also can be applied to the bolt fastening of flange 2*a* and the apparatus side.

Figure 5:
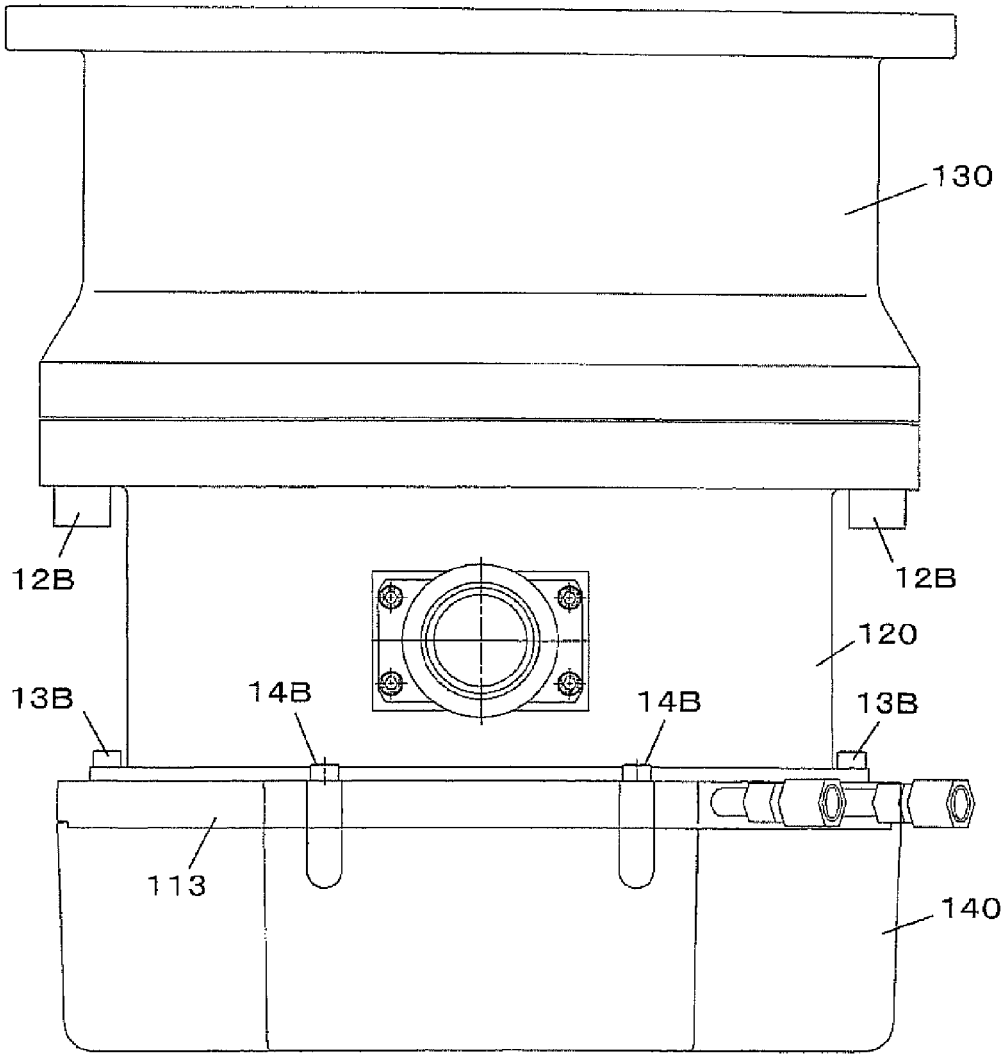
FIG. 5 is an external view illustrating an example of all-in-one turbomolecular pump integrated with an electric power source.

In addition, one of turbomolecular pumps is an all-in-one turbomolecular pump body integrated with an electric power unit; FIG. 5 is an external view illustrating an example of the like. A cooling device 113 is mounted underneath a base 120, and further a power unit 140 is mounted underneath the cooling device 113. The base 112 and the cooling device 113 are fastened with plural bolts 13B, and the cooling device 113 and the power unit 140 are fastened with plural bolts 14B.

Accordingly, a shear load in a rotation direction is forced to a bolt 12B fastening a casing 130 and the base 120 by an impact on breaking-down of a rotor, and the sear load in a reverse rotation direction would be forced to a bolt 13B fastening the power unit 140 and the cooling device 113 by a heavy power unit 140 and an inertia thereof. Accordingly, even if the present invention is applied to the bolt fastening structure and the like, the same effect as described above can be obtained.

Further, a fastening structure of turbomolecular pump of the present invention described above, e.g. as shown in FIG. 1 and FIG. 3, was illustrated as a screwed structure in which a bolt 201 from upper side in Fig., i.e. from flange 2*b* side of casing 2, is screwed into a female screw mounted in the base 1 side through a bolt hole mounted in the flange 2*b*.

However, a bolt hole of bolt 201 may be mounted in the base 1 side, and it can be mounted as a structure wherein the bolt 201 from bottom side, i.e. from the base 1, is screwed into a female screw mounted in the flange 2*b* side through the bolt hole. In this structure, the above gap-size Db is a gap formed between the bolt hole mounted in the base 1 side and the bolt 201 therewith.

Figure 6:
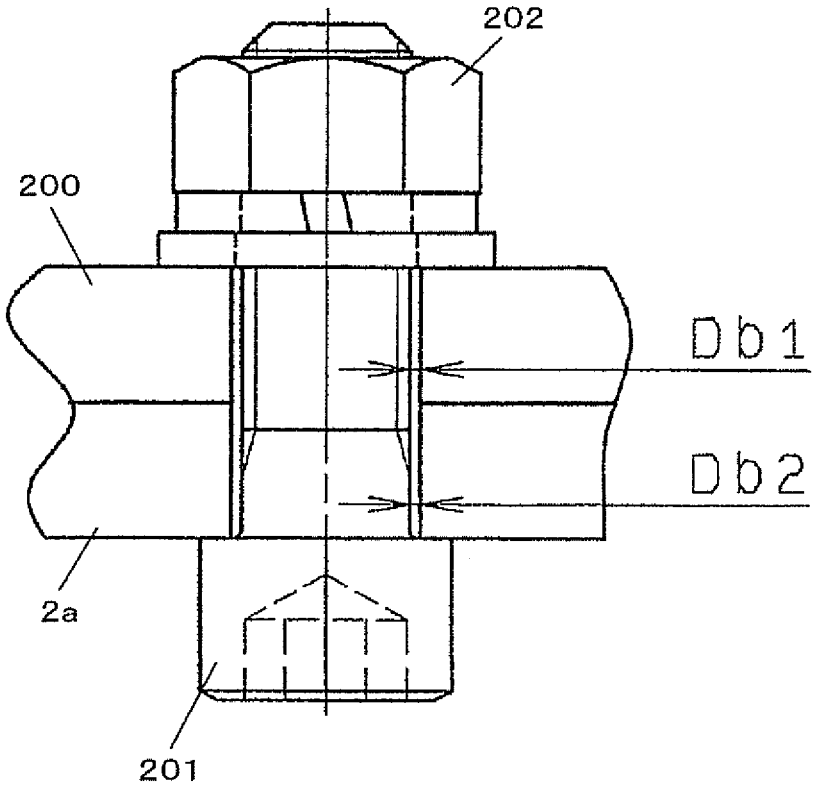
FIG. 6 is a figure illustrating a fastening structure of a bolt and a nut.

Further, referring FIG. 6, the present invention can also be applied to a bolt fastening structure fastening 2 flanges 200 and 2*a* by using a bolt 201 and a nut 202.

Such fastening structure can be also likely used to fasten a casing 2 and a base 1 even though e.g. in many cases, such bolt fastening structure is used to fasten a flange 2*a* and an apparatus side in which a turbomolecular pump is mounted. FIG. 6 is illustrating the case in which it is applied to a flange 2*a* and a flange 200 in an apparatus side. A pin structure as shown in FIG. 4 is adopted between a flange 2*a* and a flange 200, e.g. a pinhole 101 and a penetrating hole 103 are formed in the flange 2*a* side and a pinhole 102 is formed in the flange 200 of the apparatus side but not shown in FIG. 6.

In addition, a fastening structure shown in FIG. 6 can be an inverse fastening structure thereof. A bolt 201 passing through from upper side, i.e. from the flange 200 side, is structurally-fastened with a bolt in the flange 2*a* side.

Referring to FIG. 6, in case of a bolt fastening structure using a bolt 201 and a nut 202, a gap is formed between a shaft of bolt 201 and a bolt hole with respect to both flanges 2*a*, 200. If a gap-size in the flange 200 is Db1 and a gap-size in the flange 2*a* is D2, gap-size Dp1, Dp2 and a gap-size Db1, Db2 in FIG. 4 are set to satisfy the following Equation (3) which is a conditional Equation replacing the above Equation (I).

$$(Db1+Db2)\geq(Dp1+Dp2) \quad (3)$$

The above description is one Embodiment of the present invention and the present invention is not limited to the above Embodiment. A person having an ordinary skill in the art can practice a variety of variations without departing from the scope or spirit of the invention. Thus, it is intended that the present disclosure covers modifications and variation of this invention provided they come within the scope of the appended claims and their equivalents.

This application relates to the priority base application below and entire contents of which are incorporated herein fully by reference. JP Ser. No. 2011-36013, filed Feb. 22, 2011.

What is claimed is:

1. A bolt-fastening system for a turbomolecular pump, comprising:

a first member is fastened in a shaft direction of said turbomolecular pump with respect to a second member by a plurality of bolts arranged concentrically with respect to a rotor shaft center, a pair of non-penetrating pinholes of which a plurality are arranged concentrically with respect to said rotor shaft center formed opposing one another in the respective opposing faces of said fastened first and second members, a pin that provided for every said pair of pinholes and inserted into the respective pair of pinholes, and wherein if a gap-size between said bolt and said bolt hole formed in said first member is Db, and a gap-size between said pin and the pair of pinholes formed in said first member and second members is respectively Dp1, Dp2, the gap-size Db, Dp1, Dp2 satisfies an equation, D≥(Dp1+Dp2).

2. A bolt-fastening system for a turbomolecular pump, comprising:

a first member is fastened in an axial direction with respect to a second member by a plurality of bolts and nuts arranged concentrically with respect to a rotor shaft center;

a pair of non-penetrating pinholes of which a plurality are arranged concentrically with respect to said rotor shaft center formed opposing one another in the respective opposing faces of fastened said first and second members, a pin that provided for every said pair of pinholes and inserted into the respective pair of pinholes, and wherein if a gap-size between said bolt and said bolt hole formed in said first member is Db1 and a gap-size between said bolt and said bolt hole formed in said second member is Db2, each gap-size between said pin and said pair of pinholes formed in respective said first member and second member is Dp1, Dp2, the gap-size Db1, Db2, Dp1, Dp2 satisfies an equation, (Db1+Db2)≥(Dp1+Dp2).

3. The bolt-fastening system, according to claim 1, further comprising:

a pin mounting confirmation hole penetrating through a bottom of at least one pinhole and has a smaller diameter than said pinhole is formed at least in one side of said pair of pinholes.

4. The bolt-fastening system, according to claim 1 further comprising:

a parallel pin used as said pin.

5. A turbomolecular pump, comprising:

a bolt-fastening system, further comprising:

a first member is fastened in a shaft direction of said turbomolecular pump with respect to a second member by a plurality of bolts arranged concentrically with respect to a rotor shaft center, a pair of non-penetrating pinholes of which a plurality are arranged concentrically with respect to said rotor shaft center formed opposing one another in the respective opposing faces of said fastened first and second members, a pin that provided for every said pair of pinholes and inserted into the respective pair of pinholes, and wherein if a gap-size between said bolt and said bolt hole formed in said first member is Db, and a gap-size between said pin and the pair of pinholes formed in said first member and second members is respectively Dp1, Dp2, the gap-size Db, Dp1, Dp2 satisfies an equation, Db≥(Dp1+Dp2); and a rotor;

a pump-casing storing said rotor, in which a flange is formed as said first member;

a pump-base as said second member, on which said pump-casing is fixed; and wherein if a number of said pins is N, a rotation torque is τb of said pump-base which occurs when the rotor is broken, and a withstanding torque value per one said pin is τp, a number of said pins N satisfies an equation N≥τb/τp.

6. The bolt-fastening system, according to claim 2, further comprising:

a pin mounting confirmation hole penetrating through a bottom of at least one pinhole and has a smaller diameter than said pinhole is formed at least in one side of said pair of pinholes.

7. The bolt-fastening system, according to claim 2, further comprising:

a parallel pin used as said pin.

8. The bolt-fastening system, according to claim 3, further comprising:

a parallel pin used as said pin.

9. A turbomolecular pump, comprising:

a bolt-fastening system, further comprising:

a first member is fastened in an axial direction with respect to a second member by a plurality of bolts and nuts arranged concentrically with respect to a rotor shaft center;

a pair of non-penetrating pinholes of which a plurality are arranged concentrically with respect to said rotor shaft center formed opposing one another in the respective opposing faces of fastened said first and second members, a pin that provided for every said pair of pinholes and inserted into the respective pair of pinholes, and wherein if a gap-size between said bolt and said bolt hole formed in said first member is Db1 and a gap-size between said bolt and said bolt hole formed in said second member is Db2, each gap-size between said pin and said pair of pinholes formed in respective said first member and second member is Dp1, Dp2, the gap-size Db1, Db2, Dp1, Dp2 satisfies an equation, (Db1+Db2)≥(Dp1+Dp2); and a rotor;

a pump-casing storing said rotor, in which a flange is formed as said first member;

a pump-base as said second member, on which said pump-casing is fixed; and wherein if a number of said pins is N, a rotation torque is $\tau b$ of said pump-base which occurs when the rotor is broken, and a withstanding torque value per one said pin is $\tau p$, a number of said pins N satisfies an equation $N \geq \tau b / \tau p$.

10. The turbomolecular pump, according to claim 5, further comprising:

a pin mounting confirmation hole, penetrating through a bottom of at least one pinhole and has a smaller diameter than said pinhole is formed at least in one side of said pair of pinholes.

11. The turbomolecular pump, according to claim 10, further comprising:

a parallel pin used as said pin.

12. The turbomolecular pump, according to claim 9, further comprising:

a pin mounting confirmation hole, penetrating through a bottom of at least one pinhole and has a smaller diameter than said pinhole is formed at least in one side of said pair of pinholes.

13. The turbomolecular pump, according to claim 12, further comprising:

a parallel pin used as said pin.

* * * * *